United States Patent [19]

Winrow

[11] Patent Number: 5,054,504

[45] Date of Patent: Oct. 8, 1991

[54] SCALP APPLICATOR APPARATUS

[76] Inventor: Robert L. Winrow, P.O. Box 81, Earlsboro, Okla. 74840

[21] Appl. No.: 519,813

[22] Filed: May 7, 1990

[51] Int. Cl.[5] ..... A45D 24/22

[52] U.S. Cl. ..... 132/114; 132/110; 132/119.1

[58] Field of Search ..... 132/112, 113, 114, 108, 132/119.1, 320, 109, 110; 401/183, 268, 287; 128/32

[56] References Cited

U.S. PATENT DOCUMENTS

| | | | |
|---|---|---|---|
| 665,608 | 1/1901 | Kotz | 132/113 X |
| 1,014,465 | 1/1912 | Hall | 132/114 |
| 1,594,636 | 8/1926 | Smith | 128/32 X |
| 1,772,501 | 8/1930 | Shelton | 128/32 X |
| 1,832,437 | 11/1931 | Wahl | 128/32 X |
| 2,922,425 | 1/1960 | Lerner et al. | 132/112 X |
| 3,477,447 | 11/1969 | Eldredge | 132/113 X |

FOREIGN PATENT DOCUMENTS

| | | | |
|---|---|---|---|
| 0393009 | 12/1908 | France | 132/114 |
| 2307490 | 1/1976 | France | 132/112 |
| 0363993 | 12/1931 | United Kingdom | 132/109 |

*Primary Examiner*—John J. Wilson
*Assistant Examiner*—Jeffrey A. Smith
*Attorney, Agent, or Firm*—Leon Gilden

[57] ABSTRACT

An apparatus for applying lotion and permitting simultaneous manual massage of an individual's scalp is provided, including an elongate flexible bladder body mounting a rigid head member thereon. The rigid head member includes a series of parallel finger members longitudinally aligned with the bladder body, wherein fluid contained within the bladder body is directed through the finger members and exteriorly thereof through portals positioned adjacent to and spaced forward remote tips of the fingers to permit effective directing of lotion onto an individual's scalp. Modifications of the invention include replaceable fingers, wherein the fingers are provided with massaging elements and selectively include sponge sheets mounted thereon to permit a sponge application of fluid and massage.

1 Claim, 5 Drawing Sheets

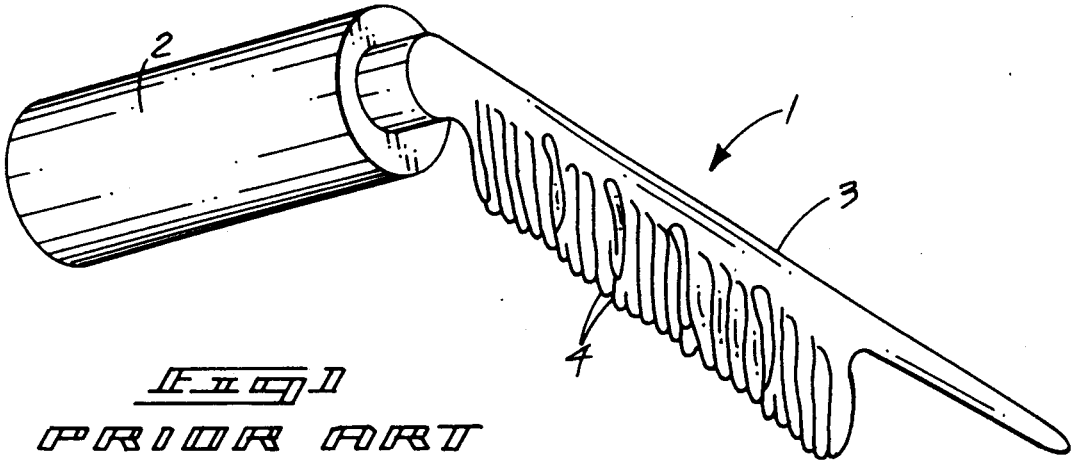
Fig 1
PRIOR ART
Fig 2
PRIOR ART
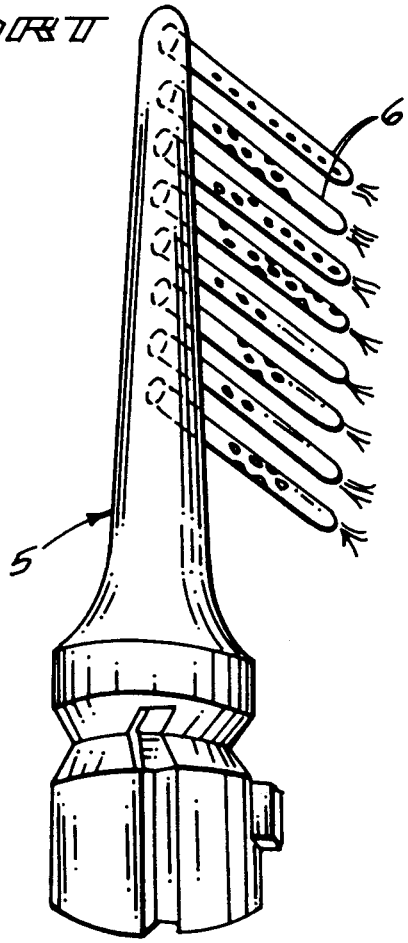

33
33
33
10a
35
25
30
27
19
13a
20
18
17
36
41
40
40
11
12

SCALP APPLICATOR APPARATUS

BACKGROUND OF THE INVENTION

1. Field of the Invention

The field of invention relates to hair-care products, and more particularly pertains to a new and improved scalp applicator apparatus wherein the same permits directing of a scalp lotion onto an individual while permitting simultaneous massage of the scalp.

2. Description of the Prior Art

Application of various hair treatment and solutions, and particularly those utilized in a professional form, are well known in the prior art. Hairdressers and the like, as a matter of course, apply lotion to a scalp while permitting the massaging of the scalp by the operator. Examples of such devices may be found in U.S. Pat. No. 4,813,439 to Morgan wherein an applicator member includes a squeeze bottle with a cap, wherein the cap includes a tooth member matrix arranged generally orthogonally relative to the bottle to permit application of various lotions to the scalp.

U.S. Pat. No. 4,585,018 to O'Connor wherein a comb includes a porous wick-like arrangement of liquid dispensing teeth.

U.S. Pat. No. 4,057,901 to Bloem sets forth a wet comb wherein a reservoir is mounted overlying a comb structure for directing of the fluid contained within the reservoir onto an individual during a combing procedure.

U.S. Pat. No. 4,676,260 to Paulhus, et al. sets forth a hair-care tool including an elongate barrel with an outwardly extending manifold aligned with the barrel, with a series of spine-like members including apertures directed therethrough permitting air flow when the apparatus is mounted to a hair dryer organization.

As such, it may be appreciated that there continues to be a need for a new and improved scalp applicator apparatus as set forth by the instant invention wherein the same addresses both the problems of ease of use, as well as effectiveness in construction and in this respect, the present invention substantially fulfills this need.

SUMMARY OF THE INVENTION

In view of the foregoing disadvantages inherent in the known types of hair treatment apparatus now present in the prior art, the present invention provides a scalp applicator apparatus wherein the same permits selective application of fluid during a massaging procedure of an individual's scalp. As such, the general purpose of the present invention, which will be described subsequently in greater detail, is to provide a new and improved scalp applicator apparatus which has all the advantages of the prior art hair treatment apparatus and none of the disadvantages.

To attain this, the present invention includes an apparatus for applying lotion and permitting simultaneous manual massage of an individual's scalp, including an elongate flexible bladder body mounting a rigid head member thereon. The rigid head member includes a series of parallel finger members longitudinally aligned with the bladder body, wherein fluid contained within the bladder body is directed through the finger members and exteriorly thereof through portals positioned adjacent to and spaced forward remote tips of the fingers to permit effective directing of lotion onto an individual's scalp. Modifications of the invention include replaceable fingers, wherein the fingers are provided with massaging elements and selectively include sponge sheets mounted thereon to permit a sponge application of fluid and massage.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved scalp applicator apparatus which has all the advantages of the prior art hair treatment apparatus and none of the disadvantages.

It is another object of the present invention to provide a new and improved scalp applicator apparatus which may be easily and efficiently manufactured and marketed.

It is a further object of the present invention to provide a new and improved scalp applicator apparatus which is of a durable and reliable construction.

An even further object of the present invention is to provide a new and improved scalp applicator apparatus which is susceptible of a low cost of manufacture with regard to both materials and labor, and which accordingly is then susceptible of low prices of sale to the consuming public, thereby making such scalp applicator apparatus economically available to the buying public.

Still yet another object of the present invention is to provide a new and improved scalp applicator apparatus which provides in the apparatuses and methods of the prior art some of the advantages thereof, while simultaneously overcoming some of the disadvantages normally associated therewith.

Still another object of the present invention is to provide a new and improved scalp applicator apparatus wherein the same permits directing of a lotion through aligned finger-like members to permit simultaneous massaging of an individual's scalp during application of the lotion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art hair treatment apparatus.

FIG. 2 is an isometric illustration of a yet further prior art hair treatment apparatus.

DESCRIPTION OF THE PREFERRED EMBODIMENT

Figure 3:
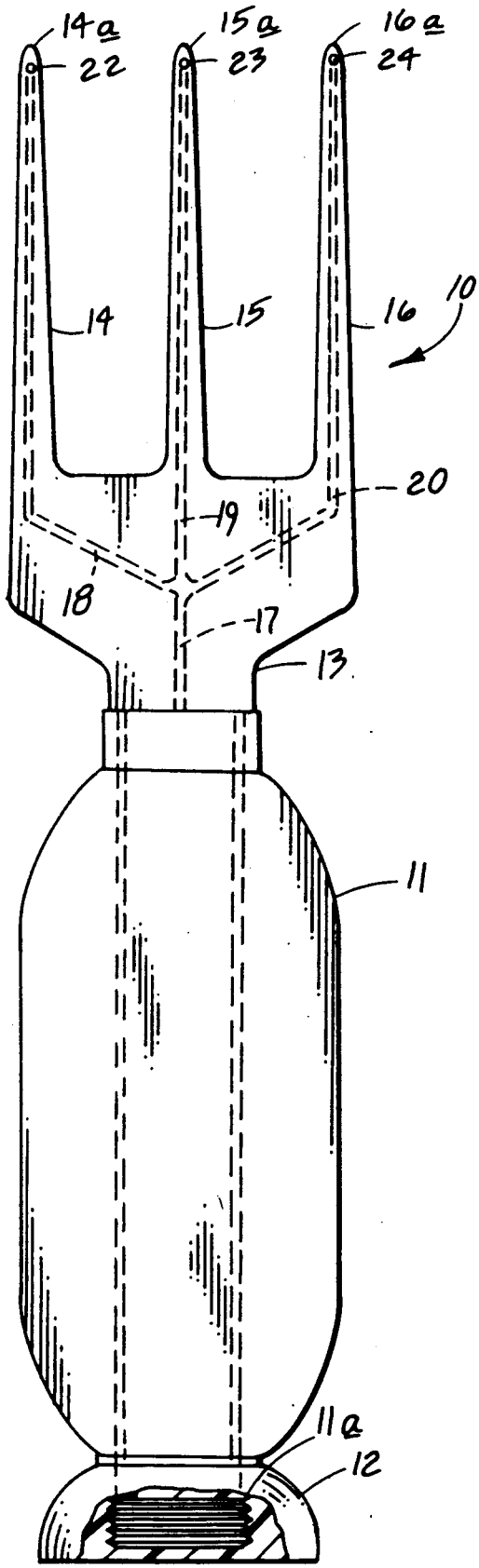
FIG. 3 is an orthographic view, taken in elevation, of the instant invention.
Figure 4:
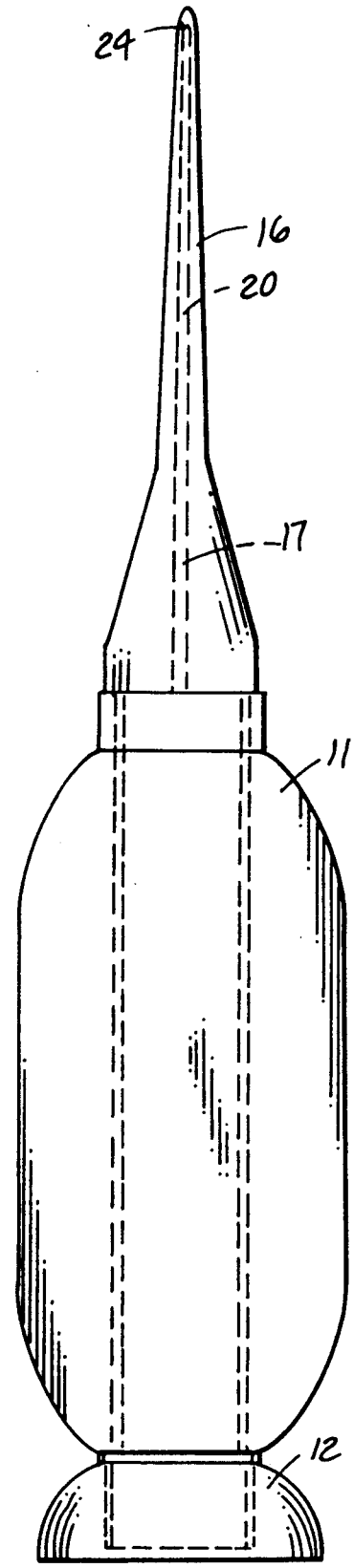
FIG. 4 is an orthographic side view, taken in elevation, of the instant invention.

With reference now to the drawings, and in particular to FIGS. 1 to 9 thereof, a new and improved scalp applicator apparatus embodying the principles and concepts of the present invention and generally designated by the reference numerals 10 and 10*a* will be described.

FIG. 1 illustrates a prior art scalp applicator apparatus 1, wherein a reservoir 2 permits directing of a fluid through a manifold 3 and through associated tooth members 4. FIG. 2 illustrates an organization 5 arranged for mounting to a hair dryer apparatus utilizing apertured spine-like members 6.

More specifically, the scalp applicator apparatus 10 of the instant invention essentially comprises an elongate longitudinally aligned flexible bladder body portion 11 accommodating a predetermined reservoir of a lotion or scalp application fluid. Access to the reservoir portion of the bladder body portion 11 is attained through a threadedly mounted cap 12 threadedly and rearwardly mounted to a rear terminal end of the body portion 11 onto a threaded shank 11*a*, as illustrated in FIG. 3 for example. A rigid head member 13, including a series of spaced parallel finger members includes a shank fixedly and longitudinally aligned with the bladder body portion 11, with the respective first, second, and third finger members 14, 15, and 16 arranged parallel to a longitudinal axis defined by the shank of the head member 13 and the body portion 11. A primary feed channel 17 is directed through the shank of the head member 13 and includes a first, second, and third feed channel 18, 19, and 20 respectively to direct a fluid from the bladder body portion 11 to the respective first, second, and third finger members 14, 15, and 16. It should be noted that each of the respective first, second, and third channels 18, 19, and 20 include a respective outlet port defined by a first, second, and third outlet port 22, 23, and 24, wherein the outlet ports are arranged in a common plane relative to one another and are spaced from and adjacent to respective forward tips defined by a first, second, and third forward tip 14*a*, 15*a*, and 16*a* of the respective first, second, and third finger members 14, 15, and 16. Application of fluid spaced from the forward tips permits massaging application of a greater surface of the finger members onto a scalp of an individual enhancing the application of fluid and the massaging of such fluid into an individual's scalp.

Figure 5:
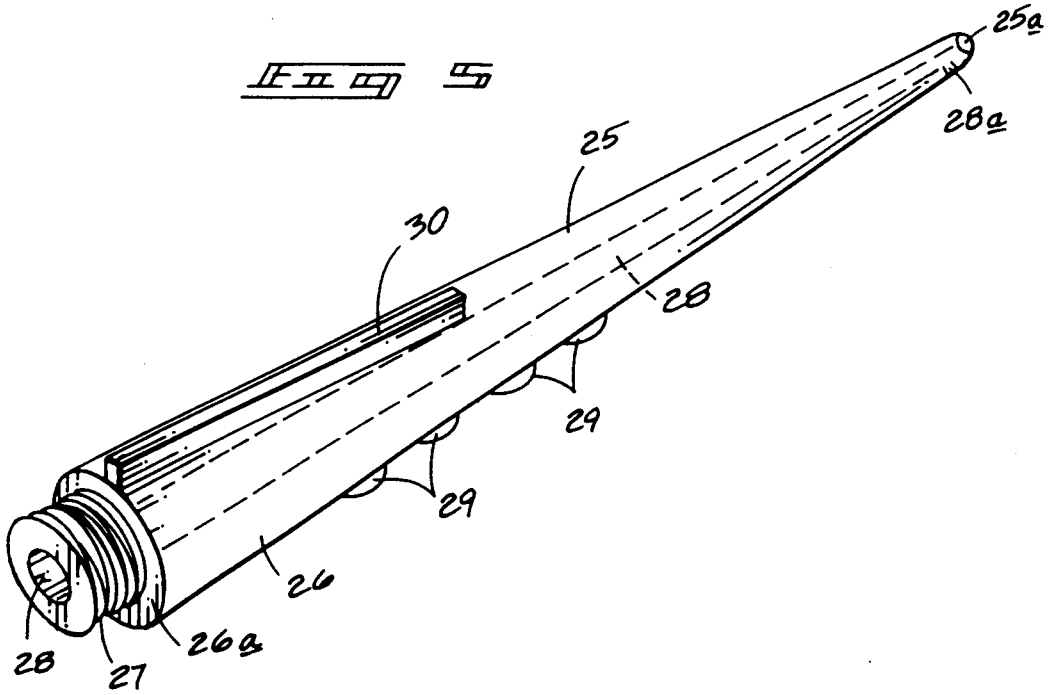
FIG. 5 is an isometric illustration of a modified finger member utilized by the instant invention.
Figure 9:
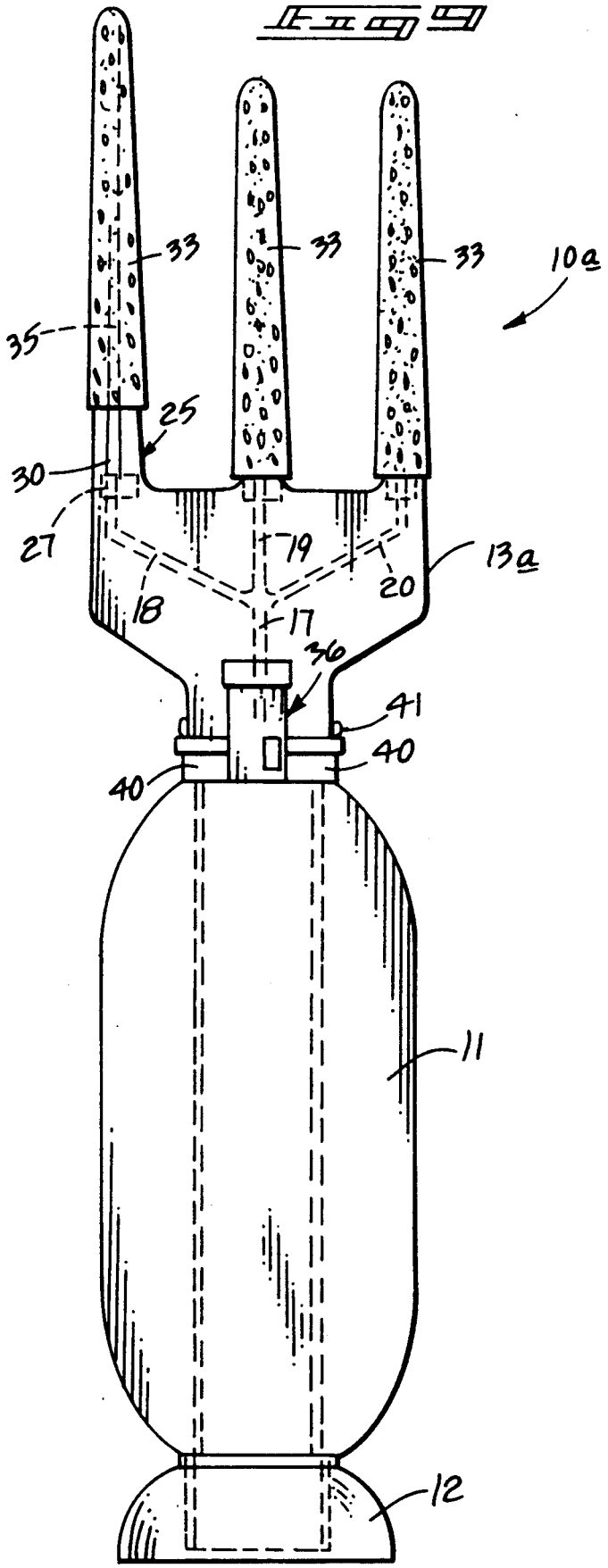
FIG. 9 is an orthographic view, taken in elevation, of a modified scalp applicator apparatus of the instant invention.

FIG. 5 illustrates a modified finger member 25, including a forward tip 25*a* defined by a conical finger body 26. The conical finger body 26 includes an elongate axis with a planar base 26*a* arranged orthogonally relative to the planar axis, with a threaded rear terminal end 27 directed rearwardly and coaxially of the conical finger body 26, wherein the threaded rear terminal end 27 is of a reduced diameter relative to the planar base 26*a* to permit reception of each terminal end 27 within an associated threaded socket in a manner as illustrated in FIG. 9 for example. A fluid channel 28 is illustrated as directed through and coaxially of the conical finger body 26, including a channel outlet port 28*a*. A series of equally spaced and aligned massage projections 29 are mounted along the exterior surface of the body 26, with an alignment rib 30 positioned diametrically in an opposed relationship to the projections 29. The alignment rib 30 is arranged for reception within a complementarily configured slot 35 mounted and formed within a sponge sleeve 33. The sponge sleeve 33 includes an internal conical cavity 34 of a complementary configuration to that defined by the conical finger body 26 and applied thereon, as illustrated in FIG. 9.

Figure 6:
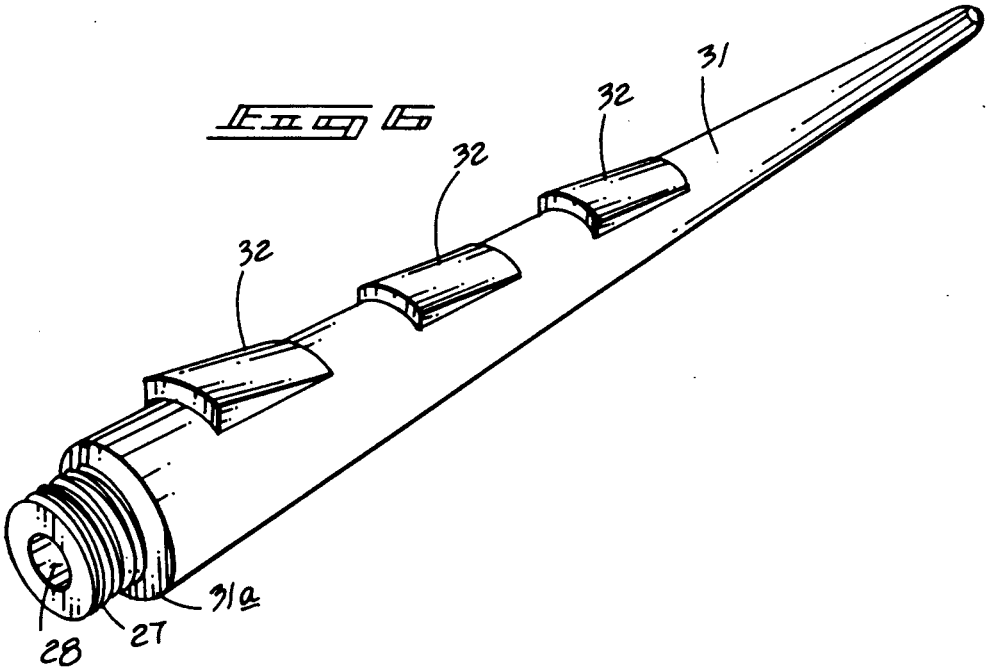
FIG. 6 is an isometric illustration of a further modified finger member utilized by the instant invention.
Figure 7:
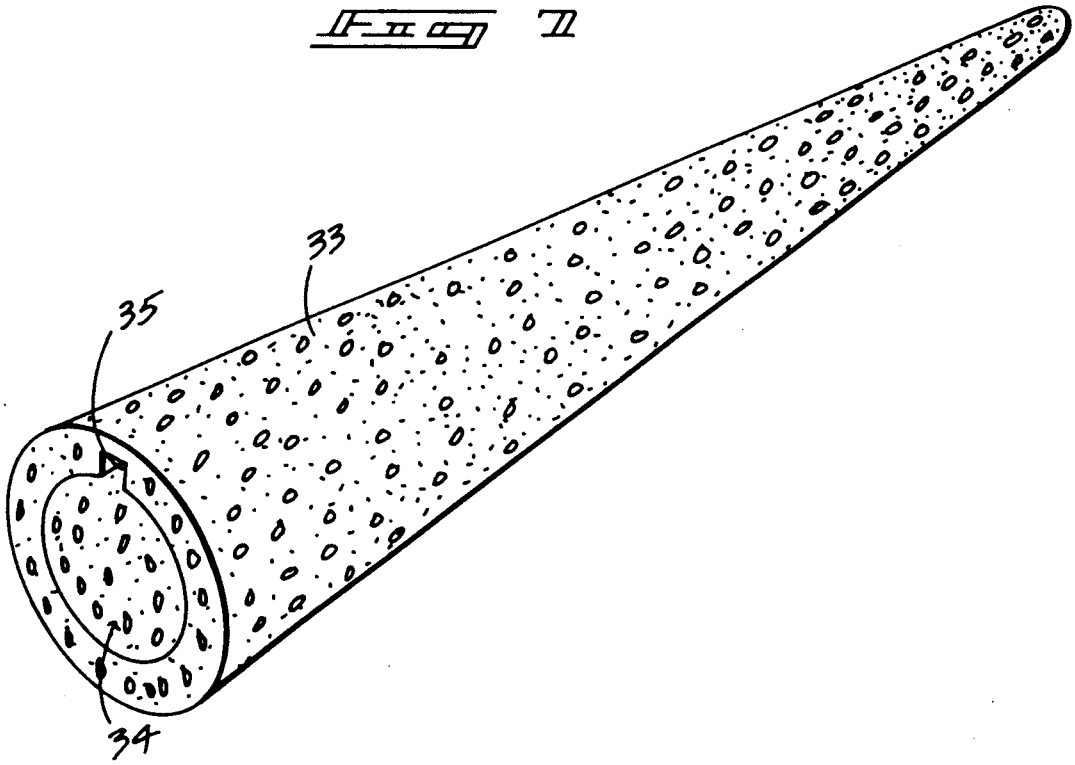
FIG. 7 is an isometric illustration of a sponge sleeve utilized by the instant invention.

FIG. 6 illustrates a further modified finger member 31, with a planar base 31*a* including a series of rearwardly directed semi-spherical abutments 32 to provide an alternative manner of securing the sponge sleeve 33 thereon. The sponge sleeve 33 in application permits saturation thereof and permits a more uniform application of a scalp lotion applied to an individual.

Figure 8:
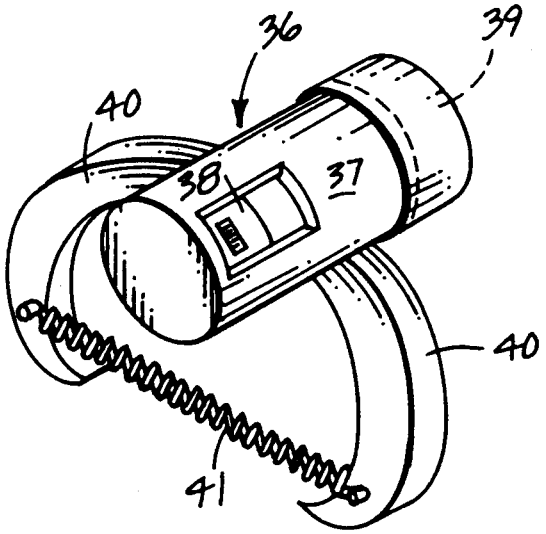
FIG. 8 is an isometric illustration of a vibratory member utilized in conjunction with the instant invention.

FIG. 8 illustrates the use of a vibrator assembly 36, including a housing 37 mounting a battery 39 therewithin. An on/off switch 38 directs application of vibratory energy through the housing 37 into arcuate fingers 40 configured for surrounding relationship relative to the shank of the modified rigid head member 13*a*, as illustrated in FIG. 9. The biasing spring 41 permits surrounding relationship relative to the shank of the modified head member 13*a* for securement of the arcuate fingers 40 thereabout. In this manner, application of lotion is enhanced by a vibratory energy applied through the rigid modified head member 13 and through the associated finger members 25.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A scalp applicator apparatus comprising, an elongate flexible bladder body, the flexible bladder body longitudinally aligned about a central body axis and including a cap threadedly mounted to a rear terminal end of the flexible body, and a rigid head member integrally mounted to a forward terminal end of the flexible bladder body longitudinally aligned therewith, the rigid head member including a rigid shank and a series of spaced parallel fingers mounted onto the rigid shank, wherein the fingers are of rigid construction and arranged parallel to the longitudinal axis of the flexible bladder body portion, and wherein the rigid head member includes a primary fluid channel in fluid communication with the flexible bladder body directed through the rigid shank of the rigid head member, and the primary fluid channel including a first, second, and third fluid channel mounted within the rigid head member, and the fingers including a first, second, and third finger member, each first, second, and third finger member including a respective first, second, and third finger channel directed therethrough, and the first, second, and third finger channels in respective fluid communication with the respective first, second, and third fluid channel, and wherein each finger member includes a respective first, second, and third forward tip, and each finger member further including a first, second, and third outlet port, wherein each first, second, and third outlet port is in respective fluid communication with the respective first, second, and third finger channel, and wherein the first, second, and third outlet ports are directed through each first, second, and third finger members spaced from and adjacent the respective first, second, and third forward tip of each finger member, and wherein each finger member is formed of a generally conical body defined about a central axis, and each finger member includes a planar rear base orthogonally arranged relative to the conical axis of each finger member, and further each finger member includes a threaded rear terminal end extending rearwardly of each planar base and each threaded rear terminal end is of a reduced diameter relative to the planar base, wherein each threaded rear terminal end is received within a threaded socket within the rigid head member, and wherein each conical finger body includes a series of equally spaced aligned semi-spherical projections directed exteriorly of the conical finger body in alignment with the respective outlet port of each finger member, and wherein each conical finger body further includes an alignment rib mounted on each conical finger body diametrically opposed to the projections, and further including a sponge sleeve, the sponge sleeve including a conical internal cavity of a complementary configuration to that defined by each conical finger body, and the conical sleeve further including an elongate slot, wherein the elongate slot complementarily receives the alignment rib of each conical finger body, and wherein each outlet port of each finger member is positioned in a single plane, and further including a vibratory assembly selectively securable about the rigid shank of the rigid head member, the vibratory assembly including an elongate housing including an on/off switch mounted within the housing, and a battery mounted within the housing, and a plurality of arcuate fingers directed downwardly from the housing and biased together including a biasing spring, the biasing spring positioned between the arcuate fingers in a surrounding relationship relative to the rigid shank of the rigid head member.

* * * * *